US006412427B1

(12) United States Patent
Merkt

(10) Patent No.: US 6,412,427 B1
(45) Date of Patent: Jul. 2, 2002

(54) APPARATUS FOR ADJUSTING THE HEIGHT OF FURNITURE UNITS NAMELY LIFT TABLES

(75) Inventor: Manfred Merkt, Spaichingen (DE)

(73) Assignee: Konrad Merkt GmbH, Spaichingen (DE)

( * ) Notice: Subject to any disclaimer, the term of this patent is extended or adjusted under 35 U.S.C. 154(b) by 0 days.

(21) Appl. No.: 09/566,134

(22) Filed: May 5, 2000

(30) Foreign Application Priority Data

May 7, 1999 (DE) ..... 199 20 939

(51) Int. Cl.[7] ..... A47B 9/00
(52) U.S. Cl. ..... 108/147
(58) Field of Search ..... 100/147, 144.11, 100/144.19; 248/188.2, 188.1, 188.6, 404, 188.5

(56) References Cited

U.S. PATENT DOCUMENTS 4,651,652 A * 3/1987 Wyckoff ..... 108/147
5,311,827 A * 5/1994 Greene ..... 108/147
5,598,789 A * 2/1997 Jonker ..... 108/147
5,682,825 A * 11/1997 Manner ..... 108/147
5,706,739 A * 1/1998 Shaheen et al. ..... 108/147
5,715,759 A * 2/1998 Lee ..... 108/147 X
6,062,148 A * 5/2000 Hodge et al. ..... 108/147
6,152,049 A * 11/2000 Schmidt ..... 108/147

FOREIGN PATENT DOCUMENTS

| | | |
|---|---|---|
| DE | 1 429 534 | 1/1969 |
| DE | 84 11 361.8 U1 | 7/1984 |
| DE | 196 26 856 A1 | 1/1998 |
| DE | 298 22 188 U1 | 5/1999 |

* cited by examiner

*Primary Examiner*—Jose V. Chen
(74) *Attorney, Agent, or Firm*—Morgan, Lewis & Bockius LLP

(57) ABSTRACT

A device for adjusting the height of pieces of furniture, in particular lift tables. The device includes two spaced apart standing feet, each of which has an inner tube which can be displaced telescopically in an outer tube and which are connected to a connecting frame. Since two rotatable driving elements are tensionally connected to the upper end region and lower end region of an inner tube of a standing foot, a high lifting speed with good synchronization is possible during height adjustments.

14 Claims, 7 Drawing Sheets

APPARATUS FOR ADJUSTING THE HEIGHT OF FURNITURE UNITS NAMELY LIFT TABLES

BACKGROUND OF THE INVENTION

The invention relates to a device for adjusting the height of pieces of furniture, and more particularly, to a device for adjusting the height of lift tables.

In order to adjust the height of office furniture, in particular of desks, use has hitherto been made of standing feet having tubes which can be pushed one into another telescopically, the standing feet each being provided with a spindle drive whose actuation causes the telescopic tubes to be displaced with respect to one another. The spindle units are synchronized via a connecting shaft, so that a synchronization results without the piece of furniture tilting. On account of the high forces which act on these spindle drives in the interior of the telescopic tubes, the said spindle drives conventionally have a very small pitch. The result is a comparatively slow height adjustment requiring, for example in the case of current lift tables of the prior art, between about 15 and 35 seconds for adjustment between the end positions for a lift of 500 mm.

German utility model 84 11 361 has disclosed a height-adjustable desk in which a cable-pull guide is routed in each case from the lower end of a telescopic inner tube via a deflecting pulley into the interior of the connecting frame between two standing feet. The cable pull is routed via two further deflecting pulleys into the opposite standing leg and is fastened there to the upper framework of the table, which is connected to the work-top. The two cable pulls which are arranged symmetrically with respect to each other result in a synchronization during the height adjustment, the said synchronization avoiding tilting of the inner tubes of the two telescopic feet. As a drive for the height adjustment a spindle drive is provided in the interior of the frame, which is provided as a transverse connection, between the two standing feet. This firstly requires a cable-pull guide which does not come into contact with the spindle drive. Secondly, this type of height adjustment still has the disadvantage referred to above of it only being possible for a very slow height adjustment to be carried out because of the spindle drive.

Furthermore, German utility model 298 22 188 has disclosed a height-adjustable desk in which the inner tubes of two standing feet are of height-displaceable design mounted on rollers on a traction cable fastened to the outer tube. The traction cables are routed via deflecting pulleys into the interior of a transversely situated connection frame. Two cable reels are arranged there one directly behind the other on the rotational axis of a driving motor, the said cable reels in each case jointly winding up or unwinding two traction cables of the left and of the right standing leg. The windings here are positioned in such a manner that the corresponding cable pulls are unwound on the one cable reel if winding up takes place on the other cable reel, and vice versa.

With one cable reel onto which two traction cables are wound simultaneously, mutual obstruction of the traction cables may occur. However, this has to be avoided in order to insure that the retracted cable length of the one cable reel corresponds exactly to the discharged cable length from the other cable reel.

The object of the invention, therefore, is to propose a device for adjusting the height of pieces of furniture, the device enabling rapid height adjustment with precise synchronization of the two telescopic feet.

Starting from a prior art item of the type mentioned in the introduction, this object is achieved by a device for adjusting the height of pieces of furniture, in particular lift tables, having two spaced apart standing feet, each of which has an inner tube which can be displaced telescopically in an outer tube, a connecting frame between the standing feet, a drive which includes a driving source for at least part of the lifting force, the drive including a device for deflecting the lifting force from the lifting direction (H) into a direction along the connecting frame, the driving source being arranged in the region of the connecting frame, and at least two rotatable driving elements which are situated with their axes transverse to the connecting frame being provided, wherein each of the two rotatable driving elements is connected to the upper end region of an inner tube of a standing foot and to the lower end region of an inner tube of a standing foot in a tensionally fixed manner.

Therefore, the advantageous designs and developments of the present invention are possible.

Accordingly, the invention proceeds from the height adjustment of a piece of furniture with two standing feet and a connecting frame connecting the standing area, a deflecting device being provided for deflecting the essentially vertical lifting force, which is required for displacing the two telescopic tubes, into the transverse direction along the connecting frame, the driving source for the drive being arranged in the region of the connecting frame, and at least two rotatable driving elements which are situated with their axes transverse with respect to the connecting frame being provided.

The drive of the invention is characterized in that each of the two rotatable driving elements is connected to the upper end region of an inner tube of a standing foot and to the lower end region of an inner tube of a standing foot in a tensionally fixed manner.

This results in the advantage that in every rotatable driving element, the length of run of the corresponding traction element which, for example when lowering the table, has to be retracted at the upper end region of an inner tube is simultaneously discharged again at the lower end region of an inner tube. This avoids it being possible for two traction elements, for example two cable pulls, to mutually obstruct each other when being retracted together on a driving element. A fluctuation when retracting or when discharging the corresponding length of the traction element, which could result due to traction elements winding over one another, is therefore reliably avoided in the case of a device according to the invention. Accordingly, a precise synchronization between the two telescopic standing feet cap be achieved, with rapid height adjustment being retained, as before.

In a particular embodiment of the invention, a cable pull for deflecting the lifting force and therefore for transferring the force from the rotatable driving element to the inner tube is provided. The deflection of the lifting force can be brought about in a particularly simple manner with a cable pull.

In one specific development of this embodiment, the driving element is connected both to the upper and the lower end region of the same inner tube. The driving element is designed in such a manner that the length, required in the lower region of the inner tube when pushing in the inner tube, of the corresponding traction element is released from the driving element, and the length, which becomes free in the upper region of the same inner tube, of the corresponding traction element is retracted. The equalizing of the length when extending the inner tube is carried out in a corresponding manner in the reverse direction. A precise synchronization is possible here even without a direct, diagonal connection between the two standing feet, for example of the upper end of the inner tube of one standing foot to the lower end of the inner tube of the other standing foot, by means of a coupling between the two driving elements. This coupling is preferably realized mechanically, for example via a gear mechanism or by installing the two driving elements on a common driving axle.

In another embodiment, however, a continuous, torsionally fixed connection of the lower end region of the inner tube of one standing foot to the upper end region of the inner tube of the other standing foot may also be provided.

Since the length of run between the two fastening points on the two inner tubes to be raised simultaneously does not vary during the height adjustment of the piece of furniture, in this arrangement the cable pull does not need to be extended or shortened during the height adjustment.

The driving element which is situated in the interior of the connecting frame may, for example, be a friction pulley, a cable pulley or a chain pinion. In the case of the last-mentioned embodiment, two deflecting and driving elements which are mechanically coupled are preferably provided in the interior of the connecting frame, so that, in this embodiment too, a synchronization of the height adjustment is achieved, which prevents the table from tilting due to differing lifts in the two standing legs.

If a driving pinion is used as the rotatable driving element, the said pinion engaging in at least one traction element running transversely with respect to the axis of the driving pinion, the use here of all of the components suitable in conjunction with a pinion, in particular a driving chain, a toothed belt and/or a toothed rack, is suitable. Such a design of the drive with the pinion and toothed traction element enables the relatively great propulsive speeds aimed for by the invention to be achieved.

In another particular embodiment of the invention, a friction wheel is used as the rotatable driving element with a cable pull wound around it. This embodiment is particularly simple in as much as, for example, a continuous cable pull from one inner tube to the other in each case can be used.

In a further particular development of the invention, a cable pull is fastened at one end to a cable pulley and when retracted is wound around the said pulley, so that when the cable is wound up by rotation of the cable pulley, the cable length is shortened, and when unwound, is extended. In a development of this embodiment, two cable ends are fastened to a cable pulley, so that during the rotation of the cable pulley, one cable is wound up and the other cable is unwound. In this manner, one cable is shortened exactly by the cable length by which the other one is extended. The cable ends are accordingly fastened at the top and bottom to an inner tube of the standing feet. In this embodiment, the traction cable to be wound up can be wound up onto the region from which the other traction cable has been unwound shortly beforehand. A space-saving, compact construction is therefore produced.

In this case, a design may be provided in which these two cables are guided diagonally, i.e. the inner tube of one standing foot is connected in the upper region, and the inner tube of the other standing foot is connected in the lower region to in each case one of these cable pulls, or else a cable guide can be selected in which one cable pull of the cable pulley is fastened in the upper end region, and the other cable pull of this cable pulley is fastened in the lower end region, of the same inner tube.

In the last-mentioned case, in each case one of the two standing feet is actuated with the corresponding cable pulls from each cable pulley, the two cable pulleys in turn being positively coupled mechanically, so that a synchronization between the two standing feet results.

An electric motor is preferably provided as the driving source, the said electric motor being especially suitable for use in the office sphere, since it operates cleanly and with low noise.

It is furthermore advantageous to provide a mechanical and/or pneumatic spring for assisting the drive. This enables the motor drive of the height adjustment to be realized in a manner which is smaller overall and therefore less costly.

A mechanical and/or pneumatic spring of this type can, for example, likewise be arranged in the region of the connecting frame. However, a spring of this type is preferably mounted within the standing feet, since the connecting frame which includes the rest of the drive can therefore be of narrower configuration, so that a more streamlined design is possible.

Furthermore, in a particular embodiment of the invention, a locking device is provided for the height adjustment. A locking device of this type can, for example, be integrated in the driving unit by corresponding self-locking, as is the case, for example in the use of a stepping motor. However, the locking arrangement can also be designed as a separate unit and can act, for example, as a break on the cable pull, on a driving pinion or on one of the driving elements, such as the driving chain, toothed belt or toothed rack.

An exemplary embodiment of the invention is illustrated in the drawing and is explained in greater detail below with reference to the figures.

In detail,

DETAILED DESCRIPTION OF THE PREFERRED EMBODIMENTS

Figure 1:
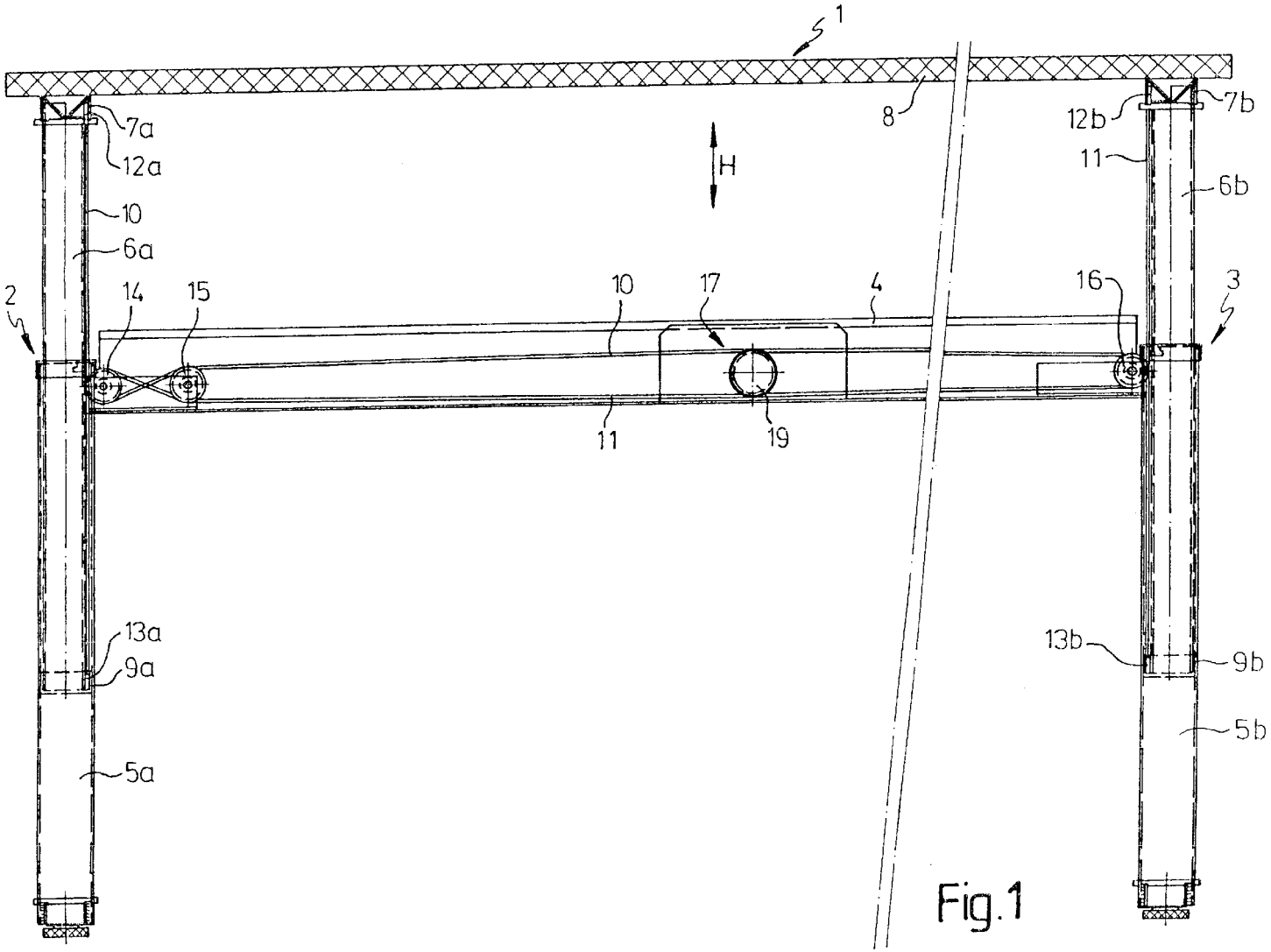
FIG. 1 shows a vertical section through a device according to the invention.
Figure 2:
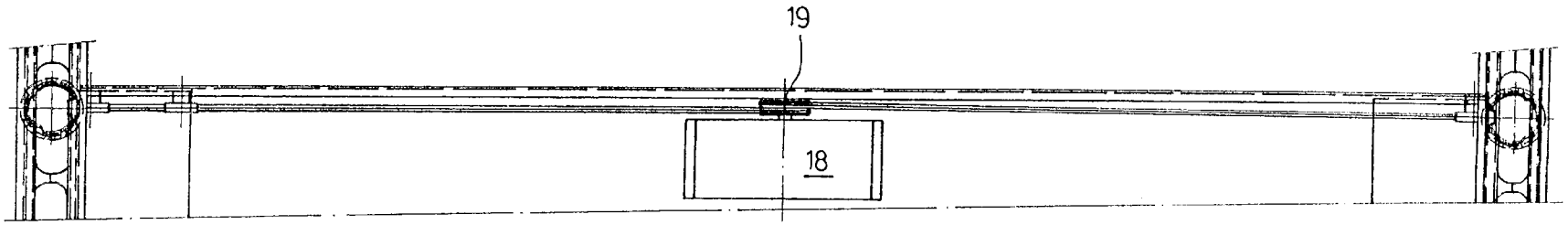
FIG. 2 shows a horizontal section through a device according to FIG. 1.

The lift table 1 according to FIG. 1 includes two standing feet 2, 3 which are connected to each other via a connecting frame 4. The standing feet 2, 3 each include an outer tube 5*a, b* in which an inner tube 6*a, b* is guided displaceably. A cable-pressing sleeve 7*a, b* is placed on the inner tubes 6*a, b,* respectively, the said sleeves being connected in turn to the table-top 8. A further cable-pressing sleeve 9*a, b* is fastened to the lower side of the inner tubes 6*a, b,* respectively. In the cable-pressing sleeves 7*a, b,* 9*a, b* two traction cables 10, 11 are connected in a tensionally fixed manner by means of corresponding nipples 12*a, b,* 13*a, b.* The traction cables 10, 11 are deflected via three deflecting pulleys 14, 15, 16 and are held in their illustrated position.

A driving source 17, which in the present case comprises an electric motor 18 having a friction wheel 19, is situated approximately in the center of the connecting frame 4.

The traction cable 10 is fastened in the cable-pressing sleeve 7*a* on the upper side of the inner tube 6*a,* runs from there downwards as far as the deflecting pulley 14, where it is deflected, and then to the deflecting pulley 15 where it is supported on the upper side thereof. The traction cable 10 then continues following the connecting frame 4 and is wound around the friction wheel 19. It extends from the friction wheel 19 to the deflecting pulley 16 by which it is deflected downwards to the lower cable-pressing sleeve 9*b*. The traction cable 10 is fastened there by the nipple 13*b*.

In a corresponding manner, the traction cable 11 runs from the upper cable-pressing sleeve 7*b,* to which it is fastened by the nipple 12*b,* downwards as far as the deflecting pulley 16 and from there along the connecting frame 4 as far as the friction wheel 19. The traction cable 11 subsequently extends to the lower side of the deflecting pulley 15 and from there onto the upper side of the deflecting pulley 14 by which it is deflected downwards to the cable-pressing sleeve 9*a* where it is fastened by the nipple 13*a*.

This cable arrangement means that there is inevitably always the same lift H in both standing feet 2, 3, since when the height adjustment is actuated in one of the standing feet 2, 3, the cable pulls 10, 11 each cause the simultaneous adjustment of the other standing foot 2, 3. If, for example, the inner tube 6*a* is pressed into the outer tube 5*a,* the inner tube 6*b* is likewise pressed in via the traction cable 11. If the inner tube 6*a* is pulled out of the outer tube 5*a,* the inner tube 6*b* is raised out of the outer tube 5*b* via the traction cable 10. Conversely, when the inner tube 6*b* is pressed into the outer tube 5*b,* the inner tube 6*a* is retracted into the inner tube 5*a* via the traction cable 10, while when the inner tube 6*b* is raised the inner tube 6*a* is also raised via the traction cable 11. The length of the two traction cables 10, 11 always remains constant during the lifting operation. A rigid equalization of the displacement between the two standing feet 2, 3 is therefore formed.

The deflecting pulley 15 makes it possible for the traction cables 10, 11 to be guided essentially in parallel in the interior of the connecting frame 4. Because of the arrangement of the driving source 17 in the connecting frame 4, there is very great structural freedom in the designing of the driving source 17. In particular, a considerably greater transmission ratio can be selected than in the case of conventional spindle drives which are situated in the interior of the tubes 5*a, b,* 6*a, b.*

Figure 3:
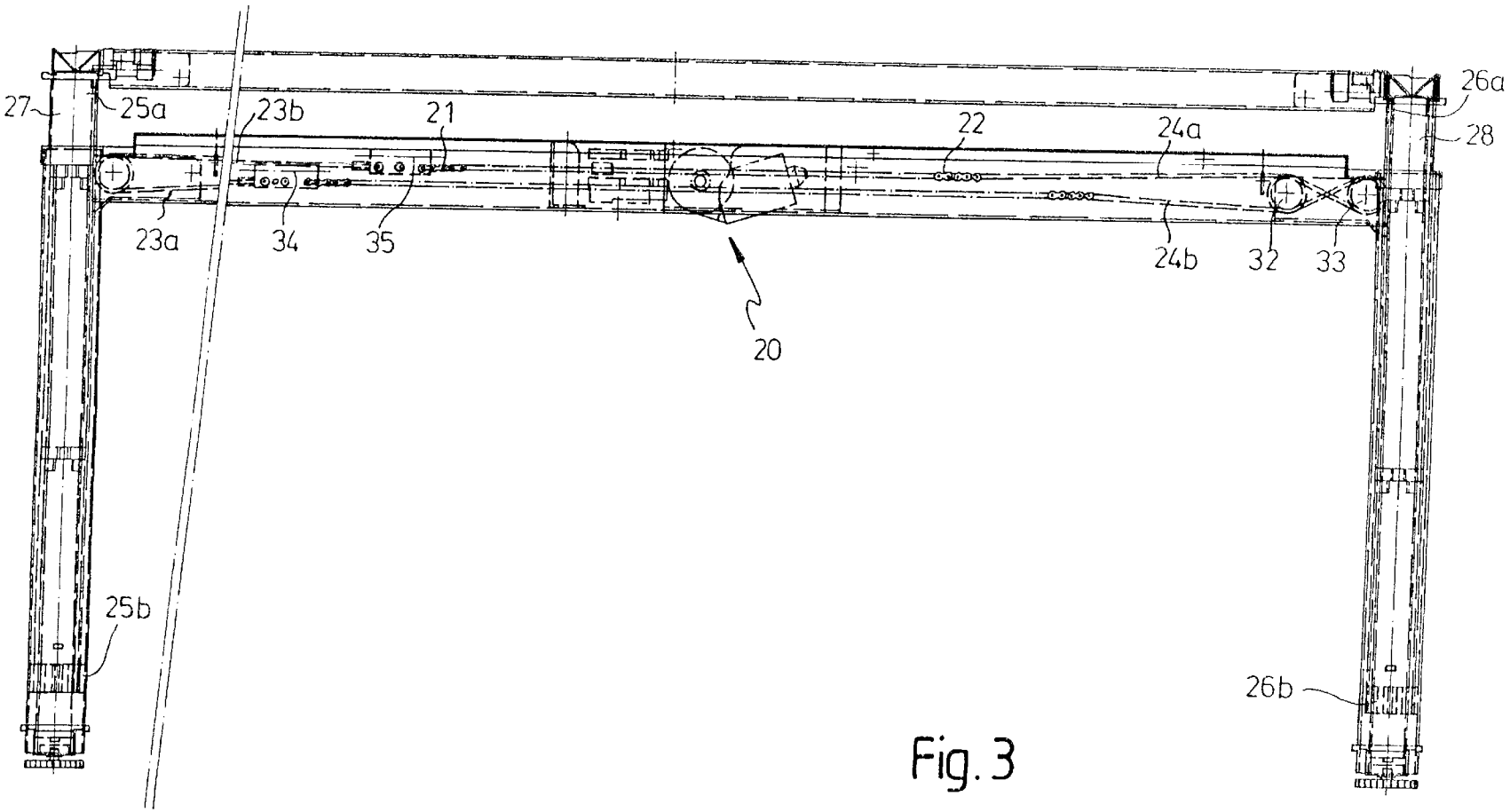
FIG. 3 shows a vertical section through a further embodiment of the device according to the invention.
Figure 4:
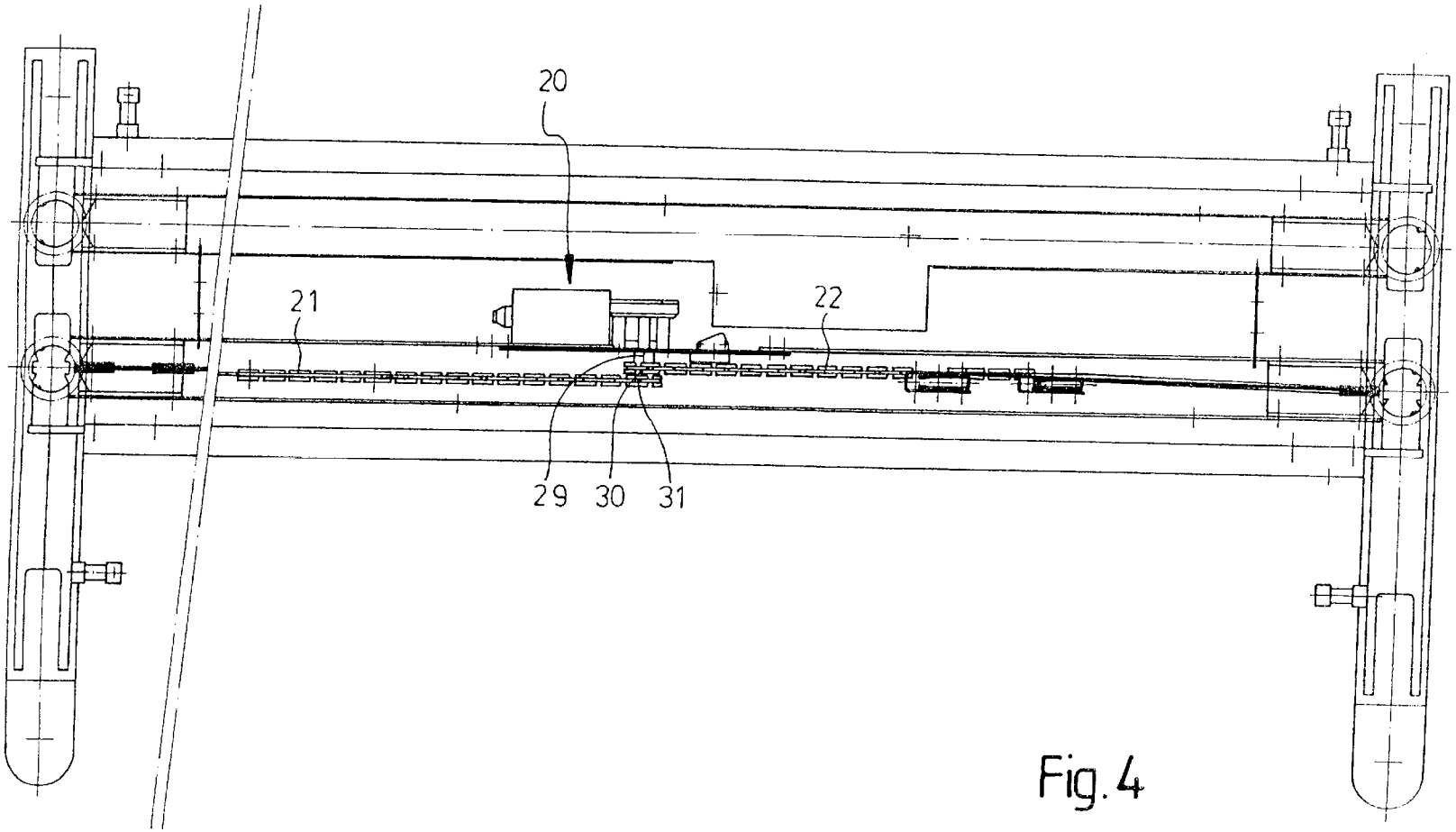
FIG. 4 shows a horizontal section through a device according to FIG. 3.

Therefore, in the device according to FIGS. 3 and 4, a driving unit 20 is selected in which chains 21, 22 may be connected at their ends to a respective cable pull 23*a/b,* 24*a/b.* The cable pull 23*a* which is connected to the chain 21 is connected to the upper end region 25*a* of the left inner tube 27. The cable pull 23*b* which is connected to the same chain 21 is connected to the lower end region 25*b* of the same inner tube 27. In a corresponding manner, the cable pull 24*b,* which is connected to the chain 22 and is deflected via corresponding deflecting pulleys, is connected to the lower end region 26*b* of the inner tube 28, and the cable pull 24*a,* which is likewise connected to the chain 22, is connected to the upper end region 26*a* of the same inner tube 28.

The two chains 21, 22 are laid over two chain pinions 30, 31 which are arranged one behind the other in the axial direction on a driving axle 29. Since the chain pinion 30 therefore has the same direction of circulation as the chain pinion 31 when the driving device 20 is operated, two deflecting pulleys 32, 33 for the cable pulls 24*a/b* are furthermore provided in order to reverse the direction of action, so that when the driving device 20 is operated in one direction of rotation, the two inner tubes 27, 28 are raised, and in the other direction of rotation are jointly lowered.

Furthermore, attached to the chain 21 are two actuating elements 34, 35 which, in at least one end position, run up to a limit switch (not illustrated in more detail) and actuate the latter. The driving device 20 is thereby stopped in the end position and further actuation is only permitted with a reversed direction of rotation.

Figure 5:
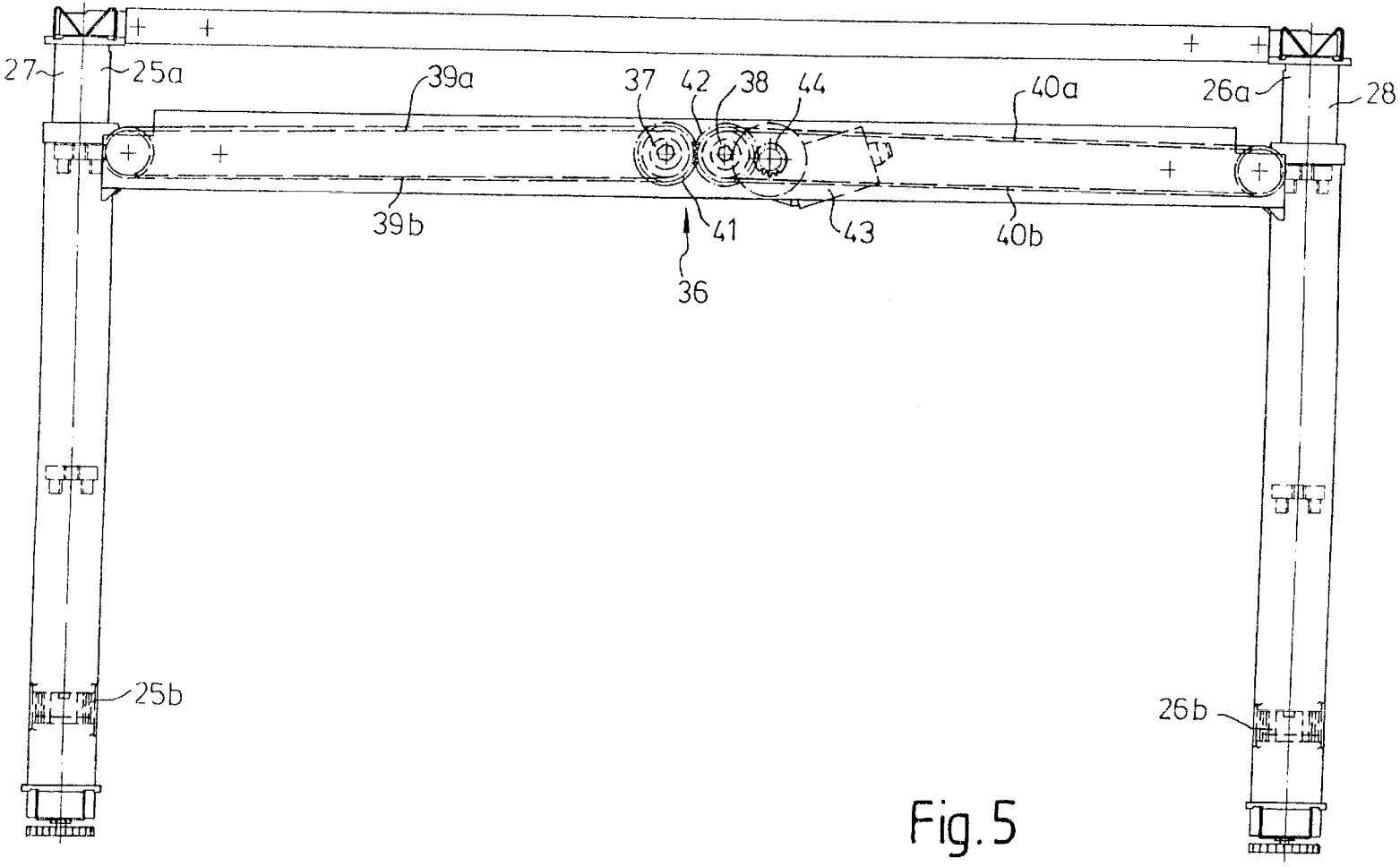
FIG. 5 shows a vertical section through a further embodiment of the invention.
Figure 6:
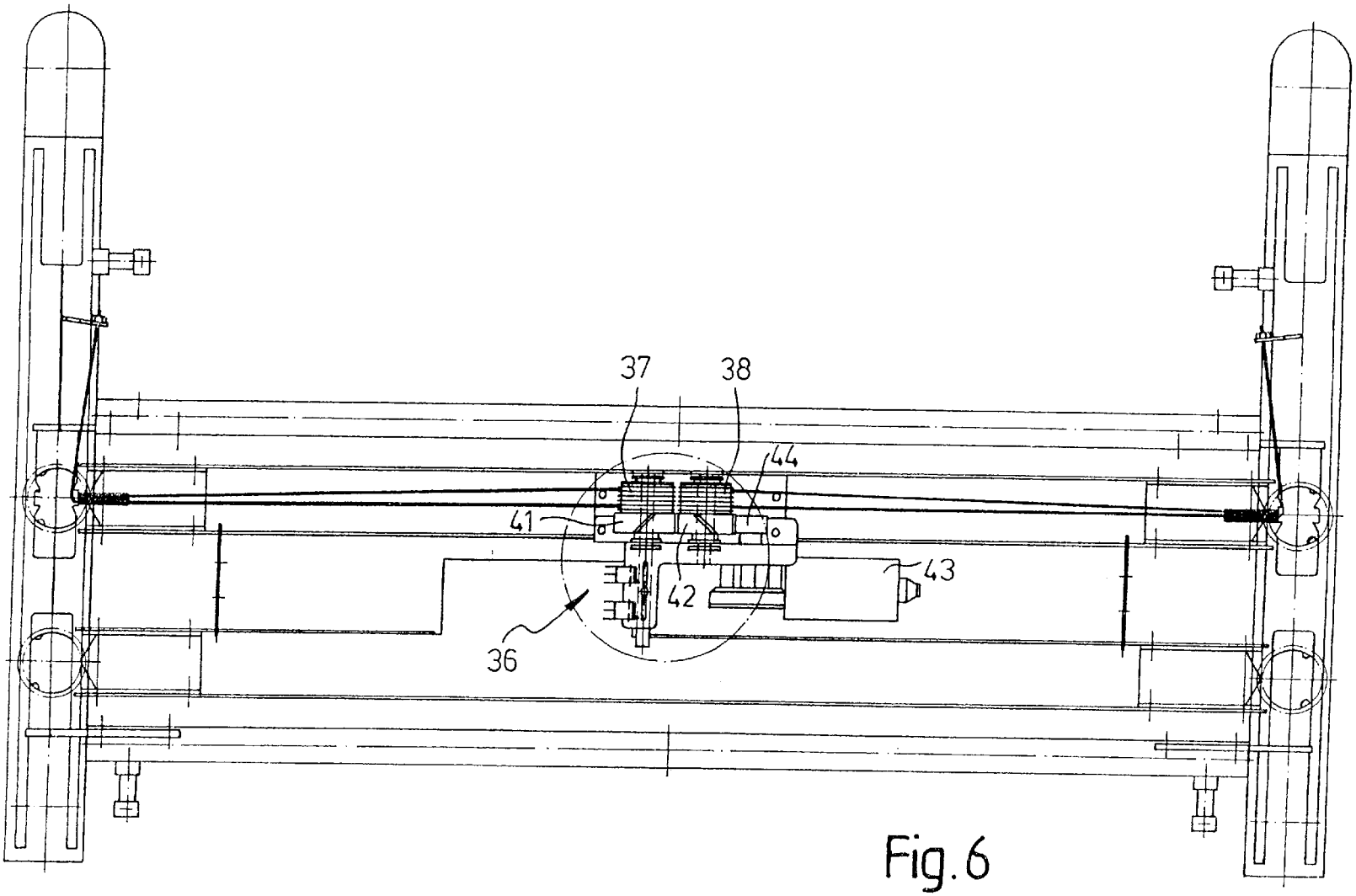
FIG. 6 shows a horizontal section through a device according to FIG. 5.
Figure 7:
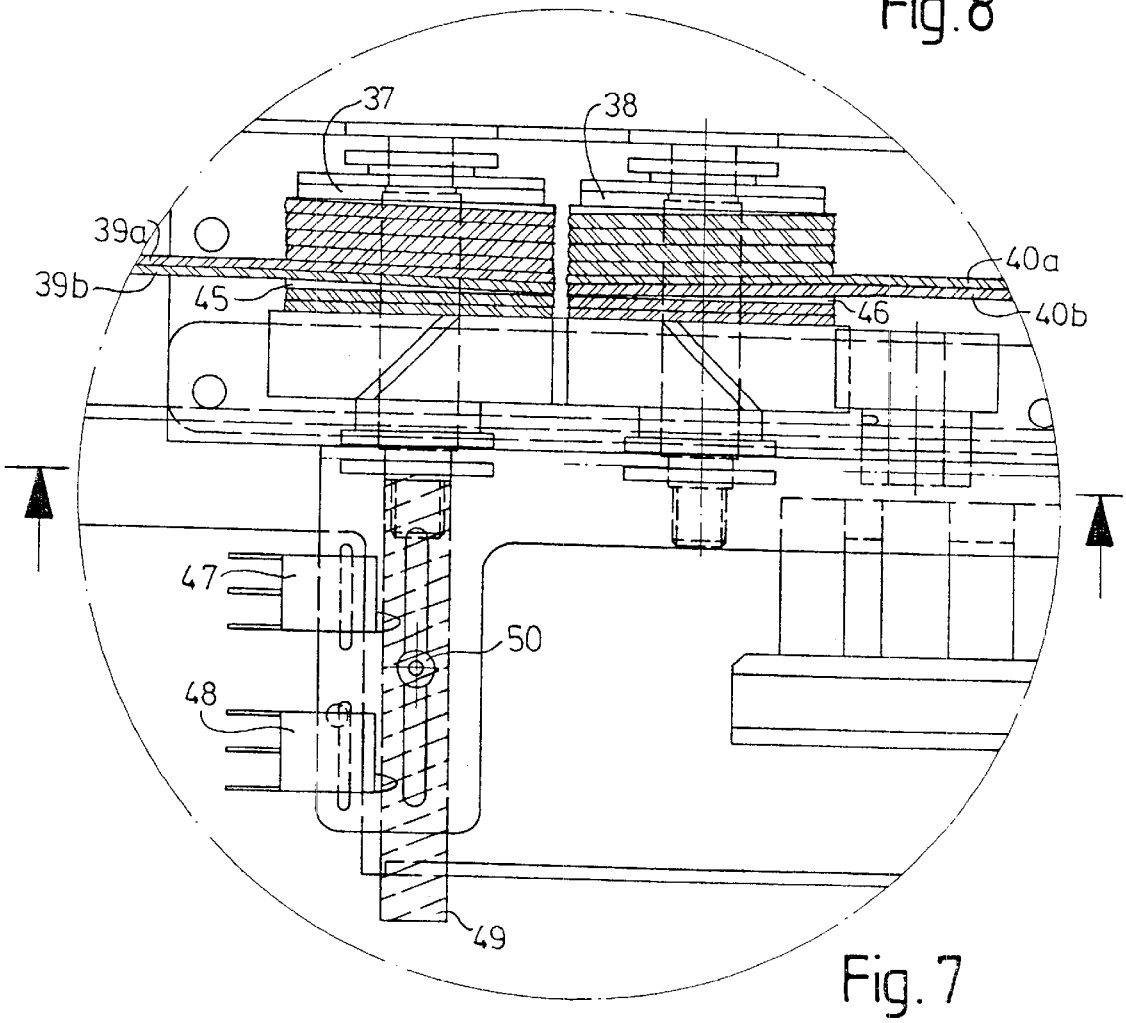
FIG. 7 shows an enlargement of part of the central driving unit of the device according to FIG. 6, in plan view.

The embodiment according to FIG. 5, FIG. 6 and FIG. 7 comprises a driving device 36 having two axially parallel cable pulleys 37, 38 arranged next to each other. Wound over each cable pulley 37, 38 are two cable pulls 39*a/b,* 40*a/b,* one 39*b* of which is connected in each case to the upper end region 25*a* of the left inner tube 27, and the other 39*a* of which is connected to the lower end region 25*b*. Accordingly, the cable pulls 40*a/b* are connected to the upper end region 26*a* and to the lower end region 26*b* of the right inner tube 28. The two cable pulleys 37, 38 are mutually engaged in a rotationally fixed manner via sprockets 40 [sic], 41, so that when one cable pulley 37 is driven, the other cable pulley 38 is inevitably driven in the opposite direction of rotation. Accordingly, the driving motor 43 also acts, with the aid of its driving pinion 44, by means of the sprocket 42 only on one cable pulley 38.

In the enlargement of the part according to FIG. 7, it can be seen that spiral-shaped guiding grooves 45, 46, in which the cable pulls 39*a/b,* 40*a/b* are guided, are provided on the cable pulleys 37, 38. The cable pulls 39*a/b* and 40*a/b* are wound in such a manner onto the cable pulleys 37, 38, respectively, that when the corresponding cable pulley 37 or 38 is rotated in a certain direction of rotation, one cable pull 39*a* or 40*a* is in each case wound onto the said pulley, while the other cable pull 39*b* or 40*b* is being unwound in the same direction of rotation from the corresponding cable pulley 37, 38. This ensures that the shortening of the cable length of one cable pull 39*a* or 40*a* is exactly equalized by a corresponding extension of the other cable pull 39*b* or 40*b*. The entire procedure is carried out in the reverse direction when the direction of rotation is reversed.

In this exemplary embodiment, the limit stop takes place via limit switches 47, 48 which are activated by an actuating element 50 driven via a spindle mounted on the driving shaft 49.

Figure 8:
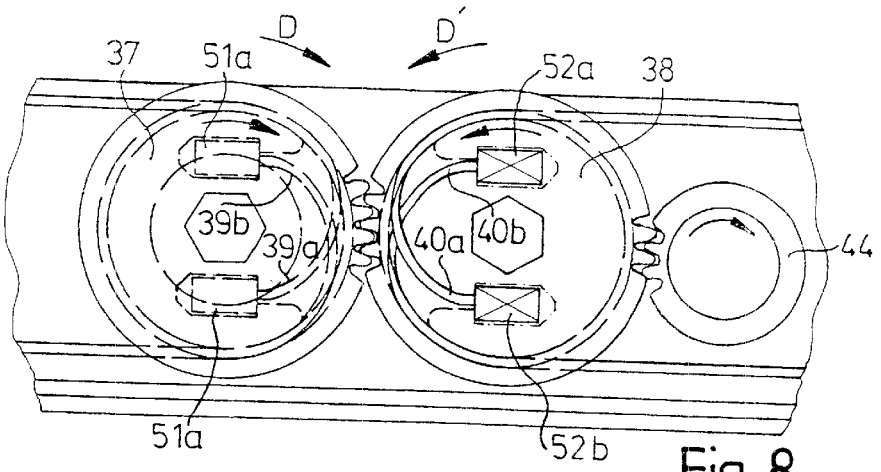
FIG. 8 shows an enlargement of part of the driving unit, in front view.

In the front view according to FIG. 8, the cable mounts 49*a/b* [sic] and 50*a/b* [sic] in the respective cable pulley 37, 38 can be seen. The cable ends of the respective cable pulls 39*a/b,* 40*a/b* are introduced into these cable mounts 51*a/b,* 52*a/b* and are fixed there, for example are locked in position.

It can furthermore be seen in this illustration that the toothing on the cable pulleys 37, 38 inevitably produces a direction of rotation D, D' which is always opposed, so that in the embodiment illustrated, in which the cable pulls 39*a/b* and 40*a/b* are in each case to be assigned to a standing foot, a deflecting pulley 32 (see FIG. 3) in the edge region of the frame can be omitted. In addition, in this embodiment the dimensioning of the circumference of the sprockets 41, 42 and of the driving pinion 44 enables a gear mechanism to be produced by means of which it can additionally be ensured that the required lifting speed is achieved without overloading the motor.

With a device for height adjustment of the type illustrated, in the case of lift tables of conventional sizes and weights for use in offices, adjusting times of the order of magnitude of 3 to 5 seconds for a lift of half a meter can be achieved. In this case, the driving source 17 can differ in design and is not restricted to the use of the electric motor in conjunction with one or more friction wheels or chain pinions or cable reels.

What is claimed is:

1. Device for adjusting the height of pieces of furniture, in particular of lift tables, comprising:

two spaced apart standing feet, each of which has an inner tube which can be displaced telescopically in an outer tube, the inner tube having an upper end region and a lower end region;

a connecting frame between the standing feet; and a drive which includes a driving source for providing at least part of a lifting force, a device for deflecting the lifting force from a lifting direction into a direction along the connecting frame, the driving source being arranged in a region of the connecting frame, and at least two rotatable driving elements which are situated with their axes transverse to the connecting frame and wherein each of the two rotatable driving elements is connected to the upper end region of an inner tube of a standing foot and to the lower end region of an inner tube of a standing foot in a tensionally fixed manner and a connection element in each case of the upper end region and of the lower end region of the same inner tube to the same rotatable driving element is provided.

2. The device according to claim 1, wherein the two driving elements are coupled mechanically.

3. The device according to claim 1, wherein a cable pull is provided for the transmission of force from at least one inner tube into the connecting frame.

4. The device according to claim 1, wherein a driving pinion is provided as the rotatable driving element, the pinion engaging, for the transmission of force, in at least one connection element running along the longitudinal axis of the connecting frame.

5. The device according to claim 1, wherein one or more of a chain, a toothed belt, and a toothed rack is provided as the connection element for the transmission of force.

6. The device according to claim 1, wherein a friction wheel is provided as the rotatable driving element with a cable pull wound around it as the connection element.

7. The device according to claim 1, wherein a cable pulley is provided as the rotatable driving element and has two cable pulls fastened to the ends as the connection elements.

8. The device according to claim 1, wherein an electric motor is provided in the region of the connecting frame as the driving source.

9. The device according to claim 1, wherein a locking device is provided in the region of the connecting frame for locking one of the connection element and rotatable driving element.

10. The device according to claim 1, wherein at least one or more of a mechanical spring and a pneumatic spring is provided in the region of the connecting frame for assisting the driving source.

11. The device according to claim 8, wherein at least one or more of a mechanical spring and a pneumatic spring is arranged in the standing feet for assisting the electric motor.

12. An adjustable lift table, comprising:

two spaced apart standing feet, each is attached to a tabletop and has an inner tube which can be displaced telescopically in an outer tube, the inner tube having an upper end region and a lower end region;

a connecting frame between the standing feet; and a drive which includes a driving source arranged in the region of the connecting frame for providing at least part of a lifting force, a device for deflecting the lifting force from a lifting direction into a direction along the connecting frame, and at least two rotatable driving elements which are situated with their axes transverse to the connecting frame, and a tension means for connecting each of the two rotatable driving elements to the upper end region and lower end region of the same inner tube of a standing foot.

13. A device for adjusting the height of pieces of furniture, in particular of lift tables, comprising:

first and second spaced apart standing feet, wherein the first standing foot includes a first inner tube having an upper end region and a lower end region, the first inner tube being coupled to a first outer tube for telescopic displacement therein, and wherein the second standing foot includes a second inner tube having an upper end region and a lower end region, the second inner tube being coupled to a second outer tube for telescopic displacement therein;

a connecting frame between the standing feet; and a drive including a driving source for providing at least part of a lifting force, a device for translating the lifting force from a lifting direction into a direction along the connecting frame, and at least two rotatable driving elements situated with their axes transverse to the connecting frame, wherein a first of the at least two rotatable driving elements drives a first drive line having a first end connected to the upper end region of the first inner tube and a second end connected to the lower end region of the first inner tube and wherein a second of the at least two rotatable driving elements drives a second drive line having a first end connected to the upper end region of the second inner tube and a second end connected to the lower end region of the second inner tube.

14. The device according to claim 13, wherein the first and second drive lines each comprises one of a chain, cable, and belt.

* * * * *